US009601830B2

(12) United States Patent
Chang et al.

(10) Patent No.: US 9,601,830 B2
(45) Date of Patent: Mar. 21, 2017

(54) ANTENNA STRUCTURE

(71) Applicant: Acer Incorporated, New Taipei (TW)

(72) Inventors: Kun-Sheng Chang, New Taipei (TW); Ching-Chi Lin, New Taipei (TW); Chung-Wen Yang, New Taipei (TW); Chuan-Chun Wang, New Taipei (TW); Kuan-Jen Chung, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

(21) Appl. No.: 14/755,240

(22) Filed: Jun. 30, 2015

(65) Prior Publication Data

US 2016/0308281 A1 Oct. 20, 2016

(30) Foreign Application Priority Data

Apr. 16, 2015 (TW) ..... 104112169 A

(51) Int. Cl.

| | |
|---|---|
| ***H01Q 1/38*** | (2006.01) |
| ***H01Q 5/00*** | (2015.01) |
| ***H01Q 9/04*** | (2006.01) |
| ***H01Q 5/371*** | (2015.01) |
| ***H01Q 1/24*** | (2006.01) |
| ***H01Q 7/00*** | (2006.01) |
| ***H01Q 9/42*** | (2006.01) |

(52) U.S. Cl.

CPC ..... *H01Q 5/371* (2015.01); *H01Q 1/243* (2013.01); *H01Q 7/00* (2013.01); *H01Q 9/42* (2013.01)

(58) Field of Classification Search

CPC ..... H01Q 1/243; H01Q 1/38; H01Q 1/385; H01Q 5/371; H01Q 9/04

USPC ..... 343/700 MS, 702, 846, 848

See application file for complete search history.

(56) References Cited

U.S. PATENT DOCUMENTS 7,289,068 B2 10/2007 Fujio et al.
8,421,705 B2 * 4/2013 Chen ..... H01Q 1/243 343/700 MS (Continued)

FOREIGN PATENT DOCUMENTS

| | | |
|---|---|---|
| CN | 103367867 | 10/2013 |
| TW | 200941827 | 10/2009 |
| TW | M397043 | 1/2011 |

OTHER PUBLICATIONS

European Search Report dated Feb. 1, 2016, issued in application No. 15177600.2-1812.

(Continued)

*Primary Examiner* — Khai M Nguyen

(74) *Attorney, Agent, or Firm* — McClure, Qualey & Rodack, LLP

(57) ABSTRACT

An antenna structure includes a ground element, a first radiation branch, and a second radiation branch. The first radiation branch has a first end and a second end. The first end of the first radiation branch is coupled to a signal source. The second end of the first radiation branch is open. The second radiation branch has a first end and a second end. The first end of the second radiation branch is coupled to the signal source. The second end of the second radiation branch is coupled to the ground element. The length of the second radiation branch is substantially equal to that of the first radiation branch.

9 Claims, 3 Drawing Sheets

(56) References Cited

U.S. PATENT DOCUMENTS

| | | | | |
|---|---|---|---|---|
| 8,750,947 | B2 * | 6/2014 | Cheng | H01Q 5/00 343/700 MS |
| 2008/0180333 | A1 | 7/2008 | Martiskainen et al. | |
| 2009/0073048 | A1 | 3/2009 | Kim | |
| 2009/0231230 | A1 | 9/2009 | Hung et al. | |
| 2013/0314297 | A1 | 11/2013 | Hamabe | |
| 2014/0184466 | A1 * | 7/2014 | Wong | H01Q 1/243 343/860 |

OTHER PUBLICATIONS

Chinese language office action dated Feb. 19, 2016, issued in application No. TW 104112169.

* cited by examiner

ANTENNA STRUCTURE

CROSS REFERENCE TO RELATED APPLICATIONS

This application claims priority of Taiwan Patent Application No. 104112169 filed on Apr. 16, 2015, the entirety of which is incorporated by reference herein.

BACKGROUND OF THE INVENTION

Field of the Invention

The disclosure generally relates to an antenna structure, and more particularly, to an antenna structure for reducing an SAR (Specific Absorption Rate).

Description of the Related Art

With advancements in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

An antenna is indispensable in a mobile device supporting wireless communication. To prevent electromagnetic waves transmitted by an antenna from negatively affecting the human body, the SAR (Specific Absorption Rate) of a mobile device is prescribed and limited by law. It becomes a critical challenge for current designers to design an antenna element which has good communication quality and meets the requirements of the law.

BRIEF SUMMARY OF THE INVENTION

In a preferred embodiment, the invention is directed to an antenna structure including a ground element, a first radiation branch, and a second radiation branch. The first radiation branch has a first end and a second end. The first end of the first radiation branch is coupled to a signal source. The second end of the first radiation branch is open. The second radiation branch has a first end and a second end. The first end of the second radiation branch is coupled to the signal source. The second end of the second radiation branch is coupled to the ground element. The length of the second radiation branch is substantially equal to that of the first radiation branch.

In some embodiments, the first radiation branch substantially has an inverted C-shape.

In some embodiments, the second radiation branch substantially has an inverted J-shape.

In some embodiments, the first radiation branch is excited to generate a low-frequency band, the second radiation branch is excited to generate a high-frequency band, the low-frequency band is from about 2400 MHz to about 2500 MHz, and the high-frequency band is from about 5150 MHz to about 5850 MHz.

In some embodiments, the first radiation branch has a first height on the ground element, the second radiation branch has a second height on the ground element, and the second height is less than 0.5 times the first height.

In some embodiments, a current maximum point of the high-frequency band is positioned at the second radiation branch, so as to reduce an SAR (Specific Absorption Rate) of the antenna structure operating in the high-frequency band.

In some embodiments, the antenna structure further includes a third radiation branch. The third radiation branch has a first end and a second end. The first end of the third radiation branch is coupled to a central portion of the first radiation branch, and the second end of the third radiation branch is open.

In some embodiments, the third radiation branch substantially has a straight-line shape.

In some embodiments, the first radiation branch has a first height on the ground element, the third radiation branch has a third height on the ground element, and the third height is from about 0.5 to about 1 times the first height.

In some embodiments, the third radiation branch is configured to adjust impedance matching of the high-frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures of the invention will be described in detail as follows.

Figure 1:
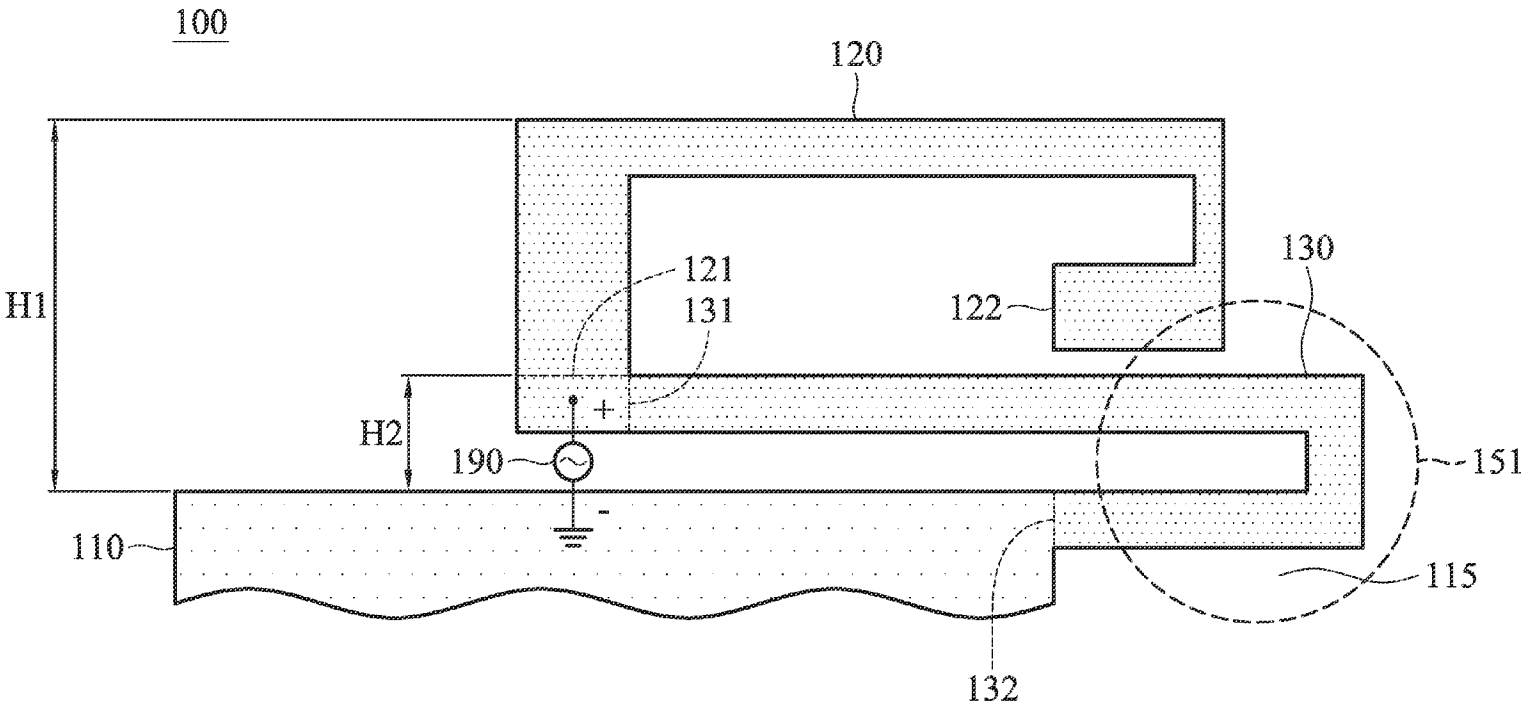
FIG. 1 is a diagram of an antenna structure according to an embodiment of the invention.

FIG. 1 is a diagram of an antenna structure 100 according to an embodiment of the invention. The antenna structure 100 may be applied in a mobile device, such as a smartphone, a tablet computer, or a notebook computer. As shown in FIG. 1, the antenna structure 100 at least includes a ground element 110, a first radiation branch 120, and a second radiation branch 130. The antenna structure 100 may be disposed on a dielectric substrate, such as a system circuit board or an FR4 (Flame Retardant 4) substrate. The ground element 110, the first radiation branch 120, and the second radiation branch 130 may be made of metal materials, such as copper, silver, aluminum, iron, or their alloys. The total length of the second radiation branch 130 is substantially equal to the total length of the first radiation branch 120.

The first radiation branch 120 substantially has an inverted C-shape. The first radiation branch 120 has a first end 121 and a second end 122. The first end 121 of the first radiation branch 120 is coupled to a signal source 190. The second end 122 of the first radiation branch 120 is open. The second end 122 of the first radiation branch 120 may further extend into the interior of the first radiation branch 120, thereby reducing the total size of the first radiation branch 120. The signal source 190 may be an RF (Radio Frequency) module of a mobile device, and it may be configured to excite the antenna structure 100. The second radiation branch 130 substantially has an inverted J-shape. The second radiation branch 130 has a first end 131 and a second end 132. The first end 131 of the second radiation branch 130 is coupled to the signal source 190. The second end 132 of the second radiation branch 130 is coupled to the ground element 110. It should be understood that the shapes of the first radiation branch 120 and the second radiation branch 130 are just exemplary, rather than limitations of the invention. In alternative embodiments, the first radiation branch 120 and the second radiation branch 130 may each have a different shape, such as a straight-line shape, a semicircular shape, an N-shape, or an S-shape.

The operation theory of the antenna structure 100 may be described as follows. The first radiation branch 120 is excited to generate a low-frequency band. The second radiation branch 130 is excited to generate a high-frequency band. The low-frequency band may be from about 2400 MHz to about 2500 MHz. The high-frequency band may be from about 5150 MHz to about 5850 MHz. Accordingly, the antenna structure 100 may support at least the communication bands of Wi-Fi and Bluetooth. Specially, the total length of the first radiation branch 120 may be about ¼ wavelength ($\lambda/4$) of a central operation frequency of the low-frequency band, such that the first radiation branch 120 is excited to generate a fundamental resonant mode and cover the aforementioned low-frequency band; and the total length of the second radiation branch 130 may be about ½ wavelength ($\lambda/2$) of a central operation frequency of the high-frequency band, such that the second radiation branch 130 is excited to generate a higher-order resonant mode and cover the aforementioned high-frequency band. With such a design, the total length of the second radiation branch 130 is substantially equal to the total length of the first radiation branch 120.

Figure 2:
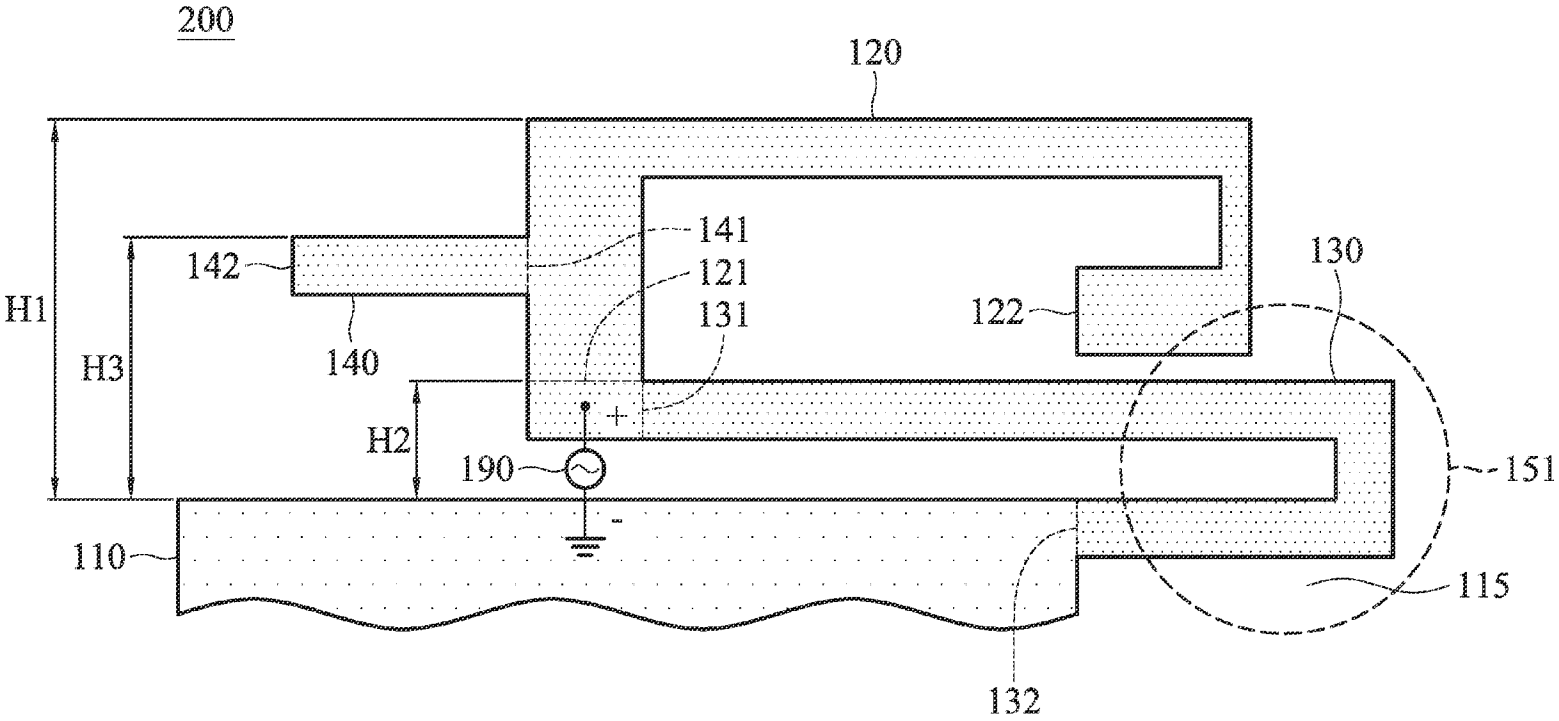
FIG. 2 is a diagram of an antenna structure according to an embodiment of the invention.

FIG. 2 is a diagram of an antenna structure 200 according to an embodiment of the invention. FIG. 2 is similar to FIG. 1. The difference between the two embodiments is that the antenna structure 200 of FIG. 2 further includes a third radiation branch 140. The first radiation branch 120 is positioned between the second radiation branch 130 and the third radiation branch 140. The third radiation branch 140 may be made of metal materials, such as copper, silver, aluminum, iron, or their alloys. The third radiation branch 140 substantially has a straight-line shape. The total length of the third radiation branch 140 is much shorter than the total length of the first radiation branch 120, or is much shorter than the total length of the second radiation branch 130. Specially, the third radiation branch 140 has a first end 141 and a second end 142. The first end 141 of the third radiation branch 140 is coupled to a central portion of the first radiation branch 120. The second end 142 of the third radiation branch 140 is open. The third radiation branch 140 is configured to adjust the impedance matching of the high-frequency band. Other features of the antenna structure 200 of FIG. 2 are similar to those of the antenna structure 100 of FIG. 1. Accordingly, the two embodiments can achieve similar levels of performance.

It should be understood that a conventional PIFA (Planar Inverted F Antenna) for supporting the Wi-Fi and Bluetooth frequency bands usually has the problem of getting a high SAR (Specific Absorption Rate) in 5G frequency bands (e.g., the frequency bands from about 5150 MHz to about 5850 MHz). For example, in a conventional PIFA, its current maximum point of the 5G frequency bands may be often positioned at a relatively short auxiliary radiation branch. The relatively short auxiliary radiation branch and a relatively long main radiation branch have the same antenna heights. Both of them are close to the human body of the user. Due to the frequency multiplication effect, the 5G frequency bands of the conventional PIFA may not meet the requirement of SAR by law. The invention adjusts the high-frequency resonant mechanism and reduces the height of the corresponding third radiation branch 140, so as to effectively solve the problem in the prior art. In the invention, the first radiation branch 120 has a first height H1 on the ground element 110, the second radiation branch 130 has a second height H2 on the ground element 110, and the third radiation branch 140 has a third height H3 on the ground element 110 (the so-called "height" means the longest spacing between a respective radiation branch and the ground element 110). The second height H2 is less than 0.5 times the first height H1. The third height H3 is from about 0.5 to about 1 times the first height H1. In other words, the second radiation branch 130 and the third radiation branch 140 of the invention are slightly tuned, and they are moved toward the ground element 110, thereby achieving inward contraction of each radiation branch. As a result, the second height H2 of the second radiation branch 130 and the third height H3 of the third radiation branch 140 are both shorter than the first height H1 of the first radiation branch 120. According to the measurement result, in the antenna structure 200 of the invention, the current maximum point of the high-frequency band is positioned at the second radiation branch 130 (as indicated by a dashed box 151). Since the antenna height of the second radiation branch 130 is relatively short and the current maximum point of the high-frequency band is away from the human body, the SAR of the antenna structure 200 operating in the high-frequency band is significantly reduced. With such a design, the 5G high-frequency bands are mainly excited by the grounded second radiation branch 130, rather than the third radiation branch 140. The third radiation branch 140 becomes merely an optional element for adjusting the impedance matching of the 5G frequency bands. In alternative embodiments, the third radiation branch 140 may be removed from the antenna structure 200. According to the measurement result, the comparison between the invention and the conventional antenna is shown in Table I.

TABLE I

Measured SAR and Antenna Efficiency (In High-frequency Bands)

| | SAR/gram | Antenna Efficiency |
|---|---|---|
| Conventional PIFA | 0.276 | 37% |
| Proposed Antenna structure | 0.156 | 47% |

Table I shows the comparison of measured SAR and antenna efficiency. According to the measurement in Table I, the invention has lower SAR but higher antenna efficiency than a conventional PIFA does in the high frequency bands (e.g., the 5G frequency bands). Therefore, the invention can have the advantages of improving both SAR and efficiency of an antenna structure.

Please refer to FIG. 1 and FIG. 2 again. The antenna structures 100 and 200 increase the total length of the second radiation branch 130 by forming a corner notch 115 on the ground element 110. That is, the width of the second radiation branch 130 is less than the width of the ground element 110, so as to form a resonant path which is different from the ground element 110. The corner notch 115 of the ground element 110 substantially has a rectangular shape.

Figure 3:
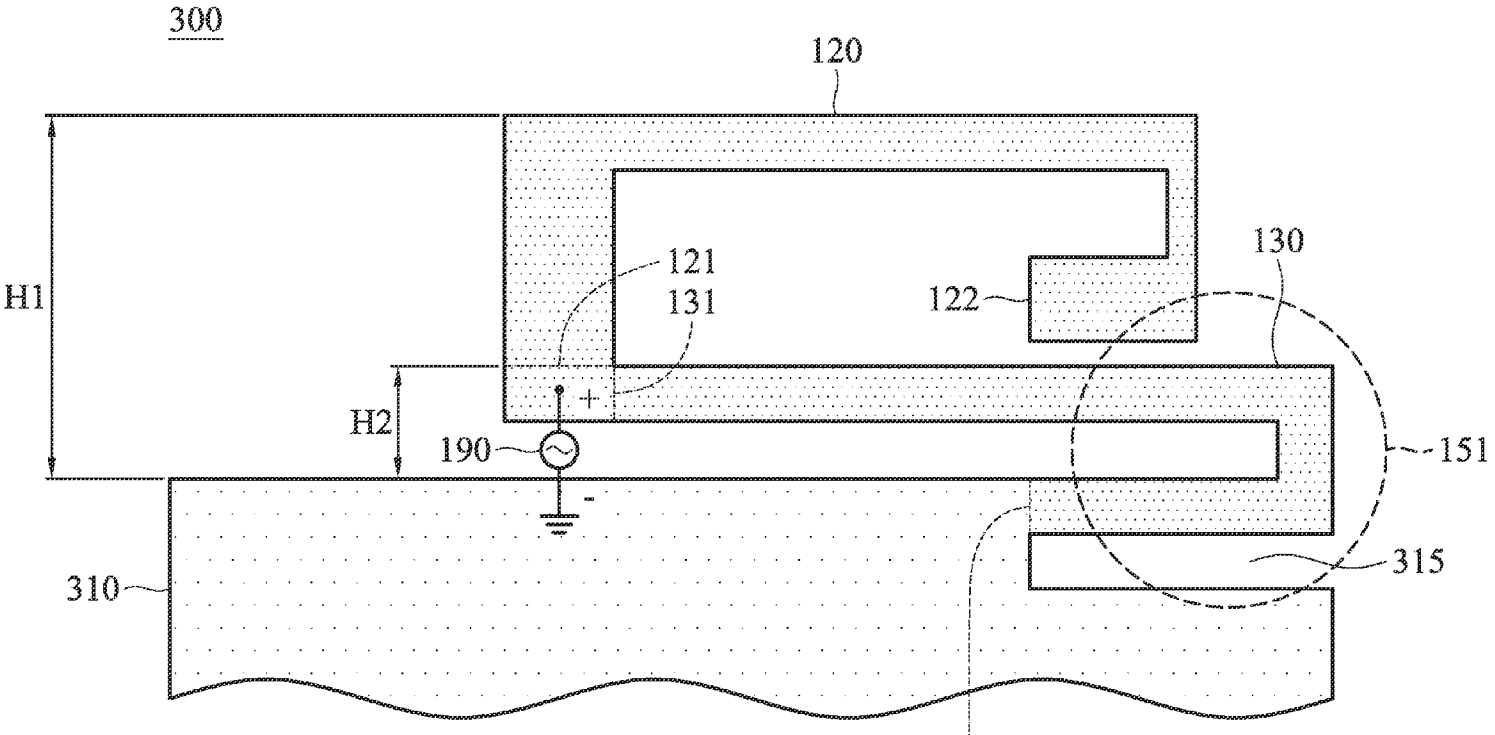
FIG. 3 is a diagram of an antenna structure according to an embodiment of the invention.

FIG. 3 is a diagram of an antenna structure 300 according to an embodiment of the invention. FIG. 3 is similar to FIG. 1. The difference between the two embodiments is that a ground element 310 of the antenna structure 300 of FIG. 3 has a notch 315, which is positioned at a central portion of a side of the ground element 310. The notch 315 is not positioned at a corner of the ground element 310. The notch 315 of the ground element 310 may substantially have a rectangular shape, a square shape, or a semicircular shape, so as to adjust the resonant length of the second radiation branch 130. Other features of the antenna structure 300 of FIG. 3 are similar to those of the antenna structure 100 of FIG. 1. Accordingly, the two embodiments can achieve similar levels of performance.

The invention proposes an improved PIFA structure. By reducing the heights of partial radiation branches and changing the shape of ground element, the invention can have higher antenna efficiency and lower SAR than the conventional PIFA, without increasing the total antenna area. Accordingly, the invention is suitable for application in a variety of small-size mobile communication devices.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-3. The invention may merely include any one or more features of any one or more embodiments of FIGS. 1-3. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. An antenna structure, comprising:

a ground element;

a first radiation branch, having a first end and a second end, wherein the first end of the first radiation branch is coupled to a signal source, and the second end of the first radiation branch is open; and a second radiation branch, having a first end and a second end, wherein the first end of the second radiation branch is coupled to the signal source, and the second end of the second radiation branch is coupled to the ground element;

wherein a length of the second radiation branch is substantially equal to a length of the first radiation branch;

wherein the first radiation branch has a first height on the ground element, the second radiation branch has a second height on the ground element, and the second height is less than 0.5 times the first height.

2. The antenna structure as claimed in claim 1, wherein the first radiation branch substantially has an inverted C-shape.

3. The antenna structure as claimed in claim 1, wherein the second radiation branch substantially has an inverted J-shape.

4. The antenna structure as claimed in claim 1, wherein the first radiation branch is excited to generate a low-frequency band, the second radiation branch is excited to generate a high-frequency band, the low-frequency band is from about 2400 MHz to about 2500 MHz, and the high-frequency band is from about 5150 MHz to about 5850 MHz.

5. The antenna structure as claimed in claim 4, wherein a current maximum point of the high-frequency band is positioned at the second radiation branch, so as to reduce an SAR (Specific Absorption Rate) of the antenna structure operating in the high-frequency band.

6. The antenna structure as claimed in claim 4, further comprising:

a third radiation branch, having a first end and a second end, wherein the first end of the third radiation branch is coupled to a central portion of the first radiation branch, and the second end of the third radiation branch is open.

7. The antenna structure as claimed in claim 6, wherein the third radiation branch substantially has a straight-line shape.

8. The antenna structure as claimed in claim 6, wherein the third radiation branch has a third height on the ground element, and the third height is from about 0.5 to about 1 times the first height.

9. The antenna structure as claimed in claim 6, wherein the third radiation branch is configured to adjust impedance matching of the high-frequency band.

* * * * *